United States Patent [19]

Fellows

[11] Patent Number: 4,677,825

[45] Date of Patent: Jul. 7, 1987

[54] THERMOMOTOR

[76] Inventor: Oscar L. Fellows, P.O. Box 201207, Austin, Tex. 78720

[21] Appl. No.: 873,686

[22] Filed: Jun. 12, 1986

[51] Int. Cl.[4] ..... F02G 1/04

[52] U.S. Cl. ..... 60/525

[58] Field of Search ..... 60/525

[56] References Cited

U.S. PATENT DOCUMENTS 4,199,945 4/1980 Finkelstein ..... 60/520

*Primary Examiner*—Allen M. Ostrage

[57] ABSTRACT

A Stirling cycle engine of unique mechanical arrangement which operates on a principle similar to that of a planetary gear, the orbital members being the displacer shaft, piston crankshafts and engine body. The pistons reciprocate when thermal energy flows through the engine, causing the displacer shaft to rotate. If the displacer shaft is retarded or held stationary by an applied electric field, the engine body begins to revolve, transmitting power to a load. The engine body is sealed, with no dynamic seals or shafts exiting the engine body, and the design is such that size can be increased without pressure containment considerations making the engine impractical. Engine mass is used as inertial storage to increase efficiency with fluctuating loads, internal engine speed is constant for high fuel efficiency while dynamic power to the load is infinitely variable and the engine is specifically designed for ease and economy of production. The versatile design allows the engine body to drive automobiles, portable equipment and stationary generators with no design change, or to operate from solar collectors, radioisotope and chemical fuel supplies without design change.

1 Claim, 8 Drawing Figures

THERMOMOTOR

BACKGROUND OF THE INVENTION

Stirling-cycle engines, sometimes called hot-air engines or hot-gas engines, are well known, as evidenced by more than 600 original and related patents, and are a genre of machines chiefly characterized by an operating process in which an internally contained quantity of gas is alternately and periodically heated and cooled, via conduction, through the walls of parts of the machine, by an external heat source and an external heat sink, in order to perform work.

These engines are attractive because of their high theoretical efficiency, their ability to utilize a large variety of fuels or energy sources, and their potential for reducing hydrocarbon emissions.

The chief difficulties inhibiting the commercial exploitation of these engines presently are that they must have high internal pressures in order to have a high specific output or efficiency or power-to-weight ratio; they must have high temperature, high pressure, dynamic seals to prevent escape of the working gas, and to separate machine lubricants from the working gas, because such mixing or contamination reduces the efficiency of the engines, and these requirements have heretofore resulted in unacceptable expense in the manufacture of these engines. Higher pressures usually result in heavier machines because the machine sections must be stronger in order to contain the internal forces, and as the engines increase in size in order to achieve higher horsepower, the weight and cost of these sections becomes impractical.

In addition to being a pressure vessel, the Stirling-cycle engine must maintain the greatest possible temperature differential between the hot side and the cold side of the engine. Therefore, conduction through the engine body and working parts must be minimized through selection of materials and through designs which reduce conductive pathways.

Lastly, the Stirling, in order to compete successfully with existing engines, must be cheap to produce, with no major retooling or special production equipment, and it must be reasonably easy to maintain, and have a service life comparable to existing internal-combustion engines of equivalent performance.

These and other considerations, as well as a history of the technical development of Stirling engines are set forth in a book by G. Walker entitled, "Stirling Cycle Machines", and by the Philips Technical Review, vol. 31, "Prospects of the Stirling engine for Vehicular Propulsion".

SUMMARY OF THE INVENTION

The invention consists of Stirling-cycle engine of improved mechanical arrangement which is more economical to manufacture, easier to maintain, more efficient, more versatile and therefore more useful than its precedecessors.

The internal operation of the engine is analagous to the movements of a planetary gear consisting of three orbital gears or "shells". Any one shell can be stationary as long as the other two are free to move. In the engine, these "shells" are comprised of the displacer shaft, the piston crankshafts and the engine body.

When the engine body is stationary, the displacer shaft rotates and the pistons reciprocate. When the displacer shaft is held stationary by an applied electric field, the reciprocating pistons and the engine body must revolve around the displacer shaft, transmitting power to an output shaft which is driven by the engine body. By varying the electric field, any degree of coupling is possible. This allows the internal engine to run at a fixed speed (and peak efficiency), while the degree of electrical coupling determines the output shaft speed and torque.

The radially-disposed-pistons-around-a-central-crankcase design allows the engine to increase in size, number of pistons, and horsepower without greatly increasing the size of the crankcase, thereby keeping the internal pressurized volumn within practical limits. The electric coupling provides a means of starting the engine (via a rotating magnetic field generated in the stator winding) and a means to couple the engine to a load with no output shaft exiting the engine body. This means that the engine body can be hermetically sealed to prevent loss of the working gas, and eliminates the need for a dynamic seal around the output shaft. The stator and induction rotor design replaces the clutch, transmission and starting motor in a conventional engine and drive train as found in vehicles, thereby increasing the efficiency and economy of use and manufacture, reducing overall weight and drive-train friction, and providing infinitely-variable output shaft speed and torque. The engine body is itself used as a drive component, in transmitting power to the output shaft, and as inertial storage to reduce power requirements to a variable or fluctuating load. In effect, the engine body is a flywheel with a central cavity for the crankcase, and pistons oriented around the radius of the body. In the reverse of standard engines, the body of this engine rotates when applying power to a load, and the displacer shaft (which in this design would be equivalent to the crankshaft in most other engines) is stationary.

The engine design, in addition to those features already explained, is such that all bearings, lubricants, moving members (with the exception of the displacer and upper section of the displacer shaft) and engine body are at sink (coolant) temperature. Only the heater head is at maximum temperature, and engine life and engine lubricant change intervals should be greatly extended in comparison with internal combustion engines. The heater head is designed to be a routine maintenance replacement item, like an oil filter.

And finally, the design of the displacer-drive mechanism is such that the duration of displacer timing (phase angle) can be set at any desired period by the design of the eccentric groove in the displacer. The displacer shaft rotates on its axis. The top, or heater-head end of the displacer shaft is equipped with two cam rollers which travel around the inside wall of the displacer in the eccentric groove. Rotation of the displacer shaft causes the displacer to reciprocate, thus moving the working gas into, or out of, the heater head.

The engine is designed for ease of manufacture. The body is made of metal, preferably of aluminum which is easy to form by casting or injection-molding techniques, the cylinders are sleeve-type replaceable cylinders of steel alloy or other material such as copper or ceramic, the heater head is made of copper or stainless steel or other material and can be fabricated by standard processes such as drawing, molding or stamping, and the pistons are three-piece constructs which can be injection-molded of aluminum or cast or molded of other material such as ceramic. Machining is very straightforward, with few pieces requiring close tolerances. Bearings can be selected from readily available types.

The invention will be described in detail hereinafter with references to drawings which are not to scale.

DESCRIPTION OF THE PREFERRED EMBODIMENTS

Figure 1:
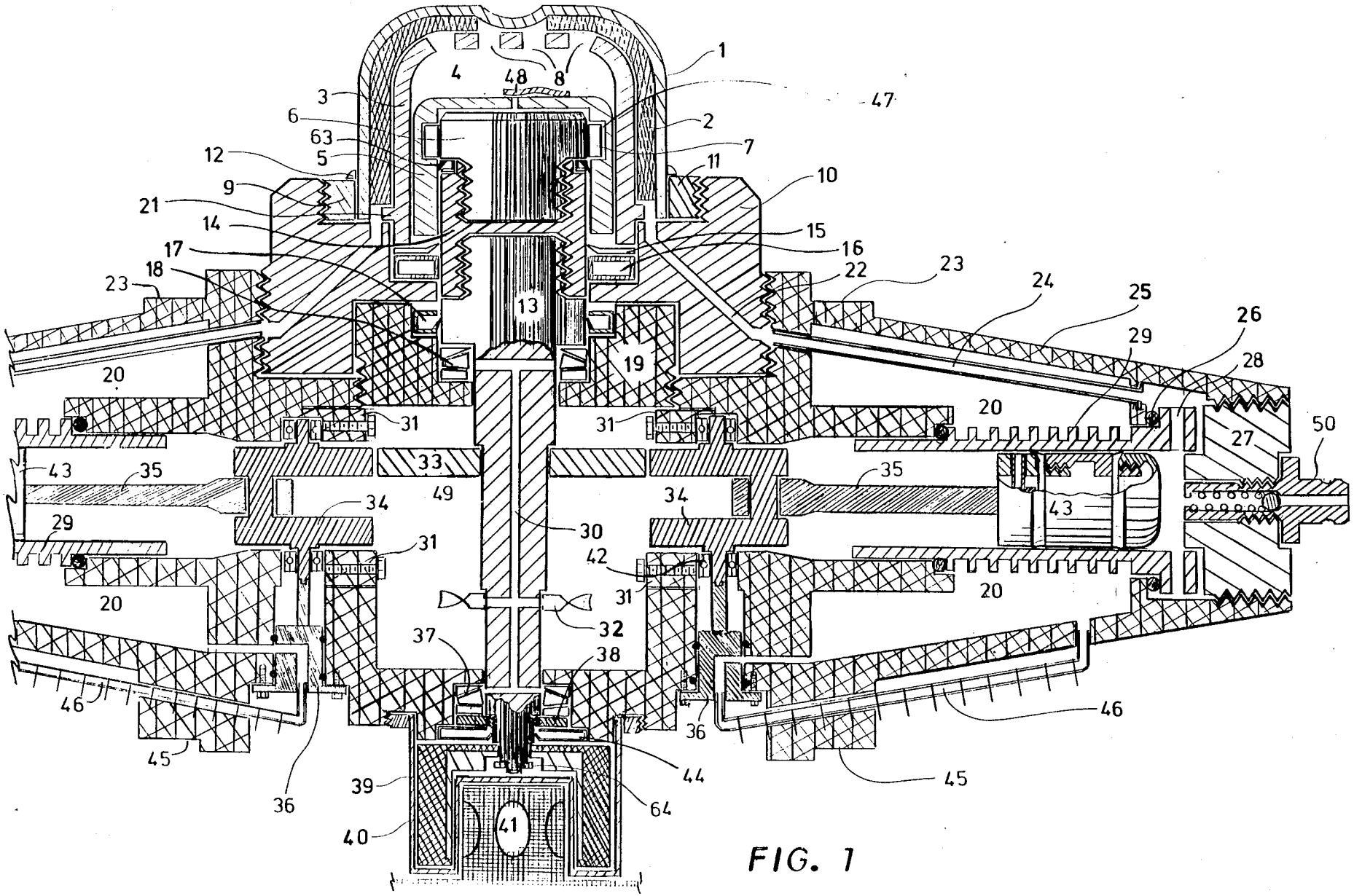
FIG. 1 is a cross-sectional view of the internal workings of the engine.

With reference to FIG. 1, numeral 1 indicates a heater head, preferably of copper or stainless steel or other metal alloy, with a layer of foamed metal 2, preferably of copper or stainless steel or other metal alloy, bonded to the inner surface. This foamed metal 2 absorbs heat energy through conduction from the heater head 1, and because the foamed metal 2 is porous, and therefore presents a large surface area to the gas which flows through it, it transfers the heat energy from the heater head to the working gas very efficiently.

Fitted inside of, and in close contact with the foamed metal 2, is a bell-shaped or cup-shaped, ceramic liner 3 with perforations 8 in its top through which the working gas can flow into or out of the displacer chamber 4.

As the displacer shafts 13, 14 and 6 revolves, the cam rollers 7 riding in the eccentric groove 47 cause the displacer 5 to move into and out of the displacer chamber 4 like a reciprocating piston. When the displacer 5 moves into the displacer chamber 4, the working gas flows out of the displacer chamber 4 through the orifices 8 in the ceramic liner 3, through the metal foam 2, through the orifice 22 in the ceramic thermal break 10, through the gas tubes 34, through the orifices 28 in the cylinder sleeves 29 and into the cylinder sleeves 29, forcing the pistons 43 to move toward the crankcase 49. The motion of the pistons 43 is transmitted through the connecting rods 35 to the piston crankshafts 34, which in turn, drive the displacer shaft 13, 14 and 6 through the displacer drive-gear 33. Thus, the reciprocation of the pistons 43 causes the rotation of the displacer shafts 13, 14 and 6, and the reciprocation of the displacer 5. The displacer 5 reciprocates at the same frequency as the pistons 43, but ninety degrees out of phase with them. The displacer-shaft gear 33 has approximately twice the number of teeth as the piston crankshafts 34, so that the displacer shaft 13, 14 and 6 revolves once in the same period that the piston crankshafts 34 revolve twice. The displacer 5 reciprocates twice for each revolution of the displacer shaft 13, 14 and 6.

Because the displacer 5 is ninety degrees out of phase with the pistons 43, it remains extended into the displacer chamber 4 as the pistons 43 begin to move back into the cylinder sleeves 29. The working gas is compressed and its temperature is increased in accordance with physical laws, and the heat thus generated is transmitted through the cylinder sleeves 29 and the gas pipes 24 to the coolant circulating in the water jacket 20. The coolant circulates through the radiator 46, giving up the heat energy to the air flowing over the radiator 46. The coolant pumps 36 are driven by the piston crankshafts 34, and circulate the coolant (which is preferably treated water) through the water jacket 20 and the radiator 46 and around the cylinder sleeves 29 and crankcase housing 49 and gas pipes 24. When the engine is not under load, and the engine body 25 is not turning, an electric fan (not shown) will force air over the radiator 46 to maintain engine temperature at a safe level.

When the displacer 5 begins to withdraw from the displacer chamber 4, causing the working gas to expand, the gas pressure and temperature drops very dramatically. This low temperature gas passes back through the metal foam 2 into the displacer chamber 4. As it passes through the metal foam 2, it takes up heat energy from the heater head 1, and the cycle is repeated.

A threaded, ceramic coupling 14 acts as a thermal break in the displacer shaft 13, 14 and 6 to reduce the amount of heat energy flowing via conduction through the shaft 13. The displacer-chamber liner 3 and thermal break 10 are also made of ceramic, in order to retard heat flow, via conduction, from the heater head area to the engine body. The heat energy must be confined to the working gas, as much as possible, for best efficiency.

The sealing ring 15 and the hollow washer 16, preferably made of titanium or some other highly conductive, high temperature material, act to seal the working gas inside the displacer chamber 4, and away from the seal 17 and bearing 18. The sealing ring 15 rides against the ceramic coupling 14, and is thin in cross-section, as in hollow washer 16, in order to take up and give up heat energy rapidly. This action reduces the temperature of the gas which reaches the seal 17, and returns the heat to the gas returning to the displacer chamber 4 from the area around seal 17. These seals 15 and 17 are not designed to prevent the working gas from reaching the crankcase, nor are the dual, back-to-back seals on the pistons 43, but are meant to retard the flow of gas to such a degree that a wide pressure differential is maintained across the pistons 43 during engine operation, a wide temperature differential between the working gas and the body of the engine, and to prevent mixing of the crankcase lubricant with the working gas.

The valve and port 48 on top of the displacer 5 allow gas trapped under the displacer 5 to return the displacer chamber 4, but do not allow the working gas to flow from the displacer chamber 4 through the top of the displacer 5.

The heater head 1 is welded to threaded ring 11, so that it can be screwed into the ceramic thermal break 10. The ceramic thermal break 10 is threaded so that it can be screwed into the engine body 25, as is the bearing boss plate 19. The induction-rotor housing 39 is made of a ceramic or polymer or other dielectric material, and also is threaded so that it can be screwed into mating threads in the engine body 25. All threaded components of the engine are meant to be assembled with application of a thread sealant such as teflon or other available materials such as silicone which will prevent the loss of the working gas.

Bearing retainers 31 hold the piston crankshaft bearings 42 and the piston crankshafts in place, and bearings 18 and 37 support the displacer shaft 13.

The threaded aluminum piece 27 retains the cylinder sleeve 29 in place and seals the working gas inside the engine body 25. This plug 27 is penetrated by a valve 50 which is the means by which gas is introduced into the assembled engine.

The seal 63 mounted on the ceramic coupling 14 is made of titanium or some other high temperature material, and its function is to prevent or retard the flow of working gas up under the skirt of the displacer 5 and into the void area between the displacer 5 and the displacer-shaft head 6.

The impeller 32 mounted on the displacer shaft 13 forces lubricant from the crankcase 49 through the lubricant passage 30 into the bearings 18 and 37, and also slings lubricant on the displacer-shaft gear 33 and piston-crankshaft gears 34 and other vital engine parts, so that necessary lubrication is maintained regardless of engine orientation.

The retaining nut 38 below the bearing 37 maintains the proper tension on the thrust bearings 18 and 37 to support the displacer shaft 13 with a minimum of lateral play and rotary friction.

The shaft seal 44 prevents lubricant from flowing from the crankcase 49 into the rotor housing 39.

The induction rotor 40 is attached to the displacer shaft 13 by a retaining nut 64 and a keyway (not shown). The rotor is composed of silicon-steel plates with current conducting segments and shorting rings of aluminum molded into them, exactly like the rotors in common induction motors. When a moving magnetic field, such as that generated by the stator 41, encounters the rotor 40, heavy electric currents are induced into the rotor segments. These currents are counter to the field inducing them, and cause the conducting segments to be repelled by the magnetic field. This phenomenon is common knowledge in electrical engineering practise, and is the basis for induction-repulsion electric motors which are in common use.

In this invention, this phenomenon is used to start the engine by producing a rotating magnetic field in the stator 41. This rotating field causes the rotor 40 and the displacer shaft 13 to rotate, and in turn, causes the displacer 5 and the pistons 43 to reciprocate. This phenomenon is also utilized by the invention to couple the engine and load, effecting a variable ratio transmission and clutch. When a stationary magnetic field is generated by the stator 41, no effect is produced in the rotor 40 as long as it is stationary. But, when the rotor 40 tries to rotate, heavy repulsion currents are induced in the rotor segments, so that the rotor 40 resists rotation with respect to the stationary magnetic field. This resistance is directly proportional to the strength of the magnetic field in the stator 41, which can be varied by varying the amount of current to the stator 41. When the engine is in operation, and no current is flowing to the stator 41, the displacer shaft 13 rotates and the pistons reciprocate within the engine body, but the engine body 25 does not rotate. When current is applied to the stator 41, the rotation of the displacer shaft 13 is retarded or stopped, depending on the amount of current applied and other factors, but the pistons 43 continue to reciprocate, and the piston-crankshaft gears 34 continue to rotate in mesh with the displacer-shaft gear 33, which results in the engine body 25 beginning to rotate around the displacer shaft 13, which is stationary with respect to the stator 41, or moving with respect to the stator 41 at a rate controlled by stator current.

Numerals 23 and 45 denote bosses on the engine body 25 where the bearings (#56 in FIG. 4) and the output gear (#54 in FIG. 2) are mounted.

Numeral 26 denotes an O-ring seal typical of seals found throughout the engine, and illustrated on the cylinder sleeves 29, on the coolant pumps 36. These O-rings seperate the lubricant, working gas and coolant spaces within the engine, so that the substances contained in each, do not mix.

Figure 2:
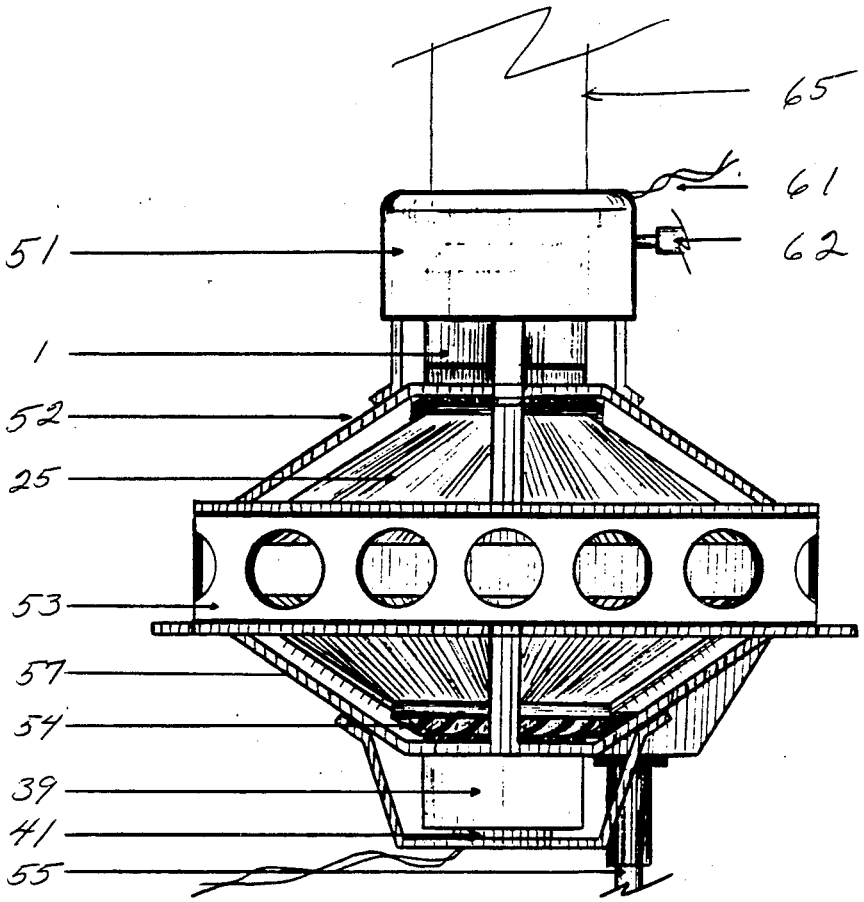
FIG. 2 is an exterior view of the assembled engine.

In FIG. 2, the engine body 25 is mounted in a frame comprised of the upper engine frame 52, lower engine frame 57 and frame spacer 53. The output gear 54 is shown affixed to the engine body 25, and in mesh with the output driven-gear 55. Other means of mounting the engine 25 and coupling it to a load are also possible, such as with sprockets and chains or pulleys and belts, without effecting the internal engine design or principle of operation.

The stator 41 is attached to the lower engine frame 57 with a mounting bracket, and the stator 41 is disposed inside of, but not in contact with, the rotor housing 39.

A typical burner assembly 51, with piezoelectric ignition 61, fuel line 62 and exhaust pipe connection 65 is shown, as one possible burner configuration, but by no means the only one. Any source of heat, if it is of sufficient temperature and can be applied properly to the heater head 1, will operate the engine with no change in design of the engine body 25.

Figure 3:
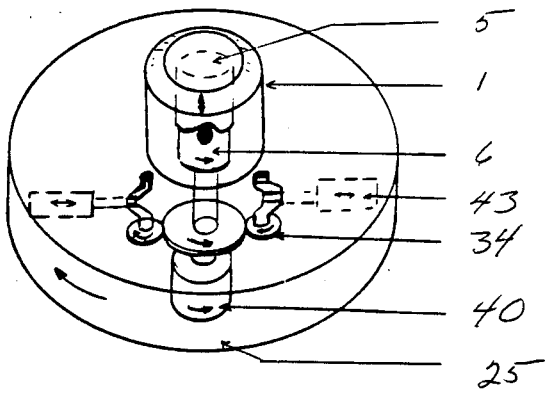
FIG. 3 is a transparent view of the engine body, showing the movements of the primary components in relation to one-another.

FIG. 3 shows the relative movements of the engine body 25, displacer shaft head 6, rotor 40, pistons 43 and piston crankshafts 34, and the displacer 5 when the engine is in operation.

Figure 4:
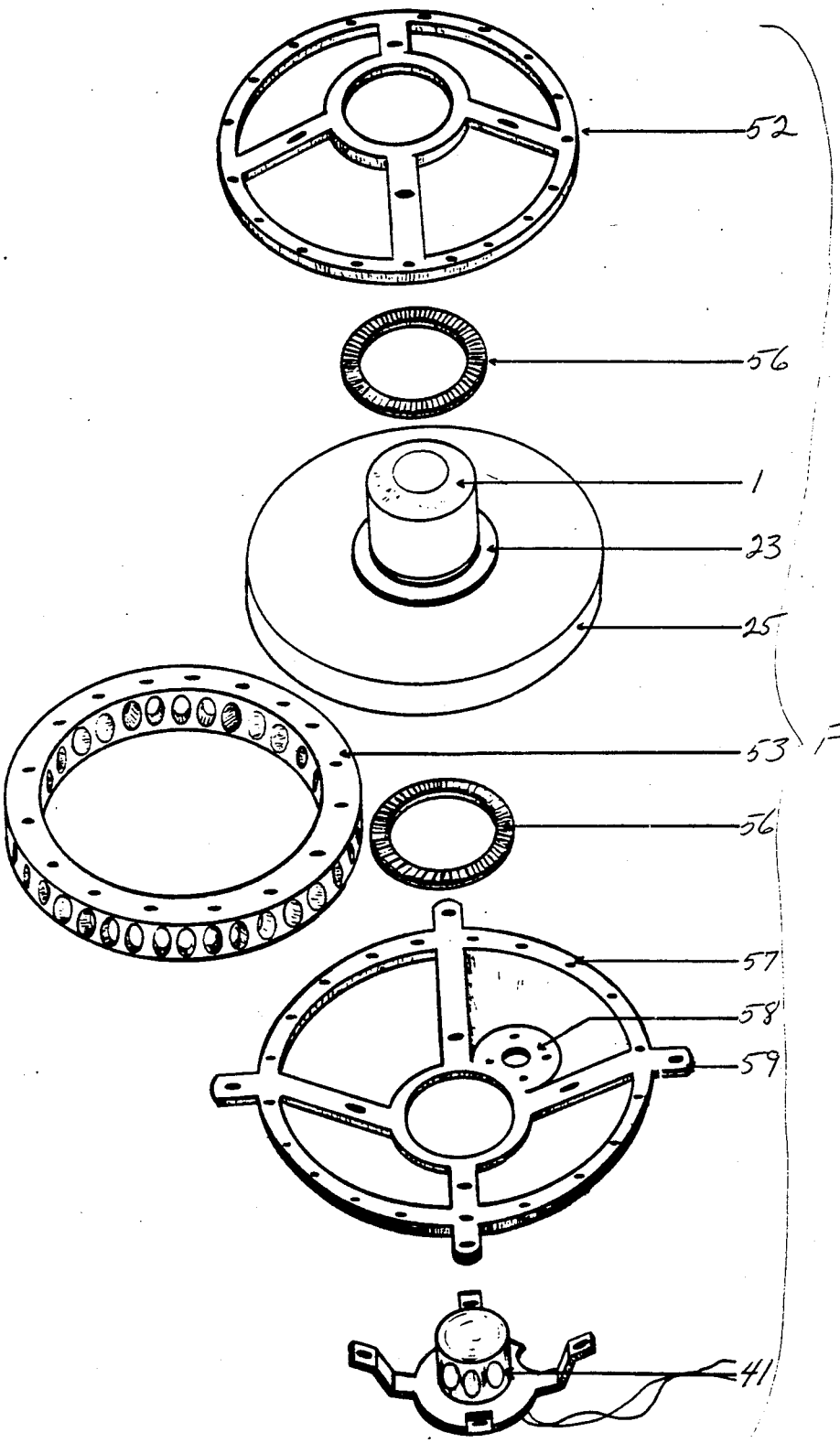
FIG. 4 is an exploded view of the engine body and mounting frame assembly with stator.

FIG. 4 is an exploded view of the engine and frame assembly, from top to bottom, upper engine frame 52, upper engine bearing 56, heater head 1, upper bearing boss 23, engine body 25, frame spacer 53, lower engine bearing 56 which is identical to upper engine bearing 56, lower engine frame 57, detailing the output shaft mounting boss 58 and frame mounting flanges 59. The stator 41 and mounting bracket are last.

Figure 5:
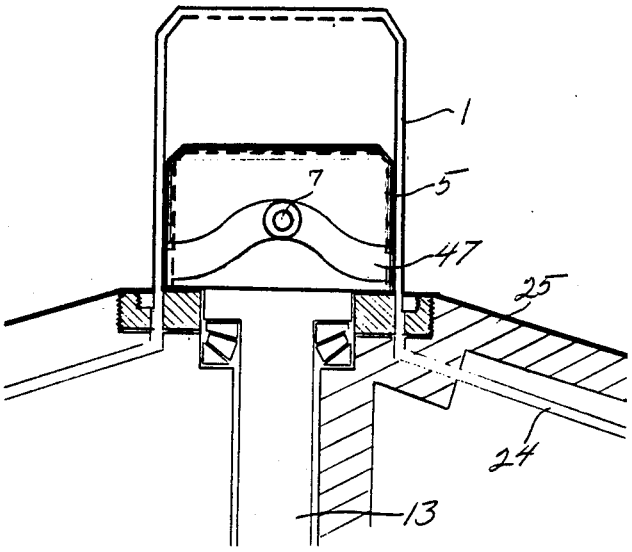
FIG. 5 is a fragmentary view showing the operation of the displacer, particularly of the camming action of the displacer-shaft rollers in the eccentric groove of the displacer.

FIG. 5 is a fragmentary view detailing the operation of the displacer 5. The cam rollers 7 orbit the inside of the displacer 5, traveling in the displacer groove 47, which is eccentric with respect to the length of the displacer 5. As the cam rollers 7 rotate around the inner wall of the displacer 5, the rollers 7 bear upon the upper and lower lands of the groove 47, causing the displacer 5 to reciprocate at right angles to the rotation of the cam rollers 7. Thus, the rotary motion of the displacer shaft 13 is converted to reciprocating motion in the displacer 5.

Figure 6:
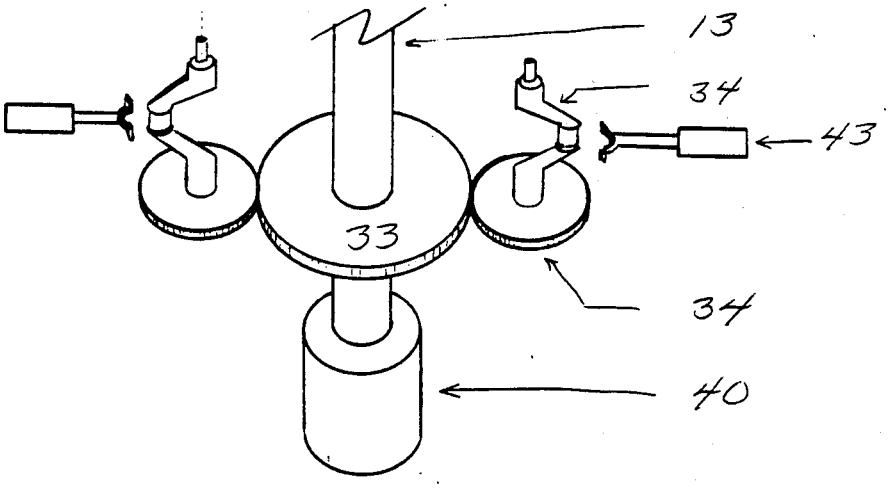
FIG. 6 is a fragmentary, exploded view of the displacer shaft gear, induction-rotor, piston crankshafts and gears, and pistons, caricatured for ease of understanding thier relationships to one-another.

FIG. 6 shows a larger view (not exact in dimension or appearance) of the displacer shaft gear 33 and piston crankshaft gear 34 train.

Figure 7:
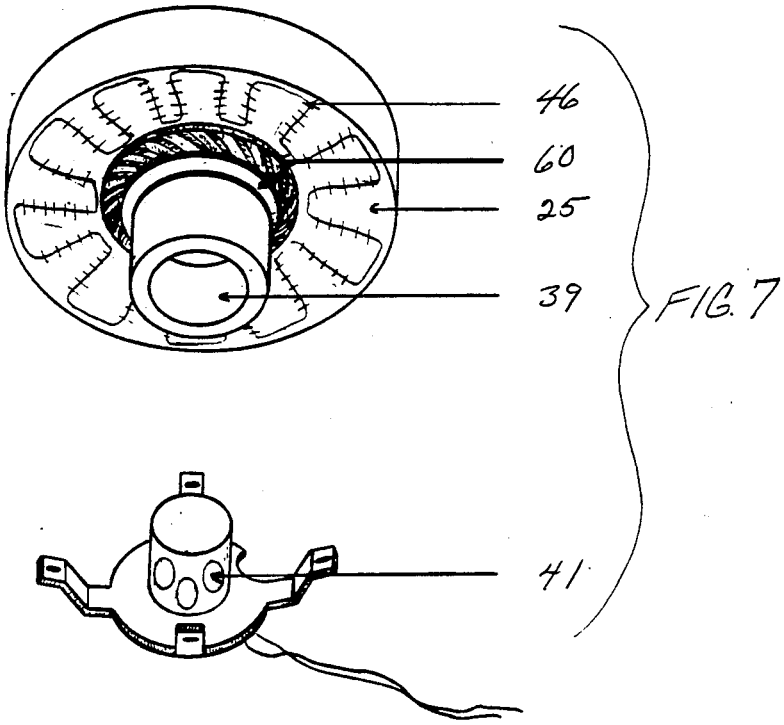
FIG. 7 is a view of the underside of the engine body, showing the radiator, output drive-gear, induction-rotor housing and stator assembly.

In FIG. 7, the radiator 46 is shown disposed on the underside of the engine body 25. The lower engine bearing race 60 is an annular ring which is attached to the engine bearing boss (#45 in FIG. 1) and supports the output gear (#54 in FIG. 2) as well as the lower engine bearing. The stator 41 fits into the cavity of the rotor housing 39, but is not attached to it. The rotor housing 39 is free to revolve around the stationary stator 41.

Figure 8:
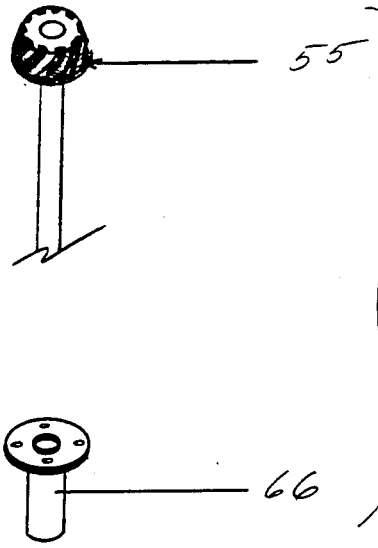
FIG. 8 is of the output driven-gear and shaft, which meshes with the output drive-gear in FIG. 7.

FIG. 8 details the output shaft and gear 55 and the shaft housing 66 which secures the output shaft 55 into the lower engine frame (#57 in FIG. 2), so that the output shaft gear 55 properly meshes with the output gear (#54 in FIG. 2).

I claim:

1. A Stirling cycle machine of unique mechanical arrangement, comprising a rotatable engine body having a heater head at one end, with a lining of open-cell, foamed metal bonded to its inner surface; a displacer which reciprocates within the heater head; a rotor housing at the opposite end from the heater head, composed of a material which is permeable to electric and magnetic fields, so that said fields pass through said housing uneffected in order to induce currents into the rotor housed within said housing; a plurality of cylinders disposed radially about the circumference of said engine body; a plurality of pistons disposed respectively in said cylinders, said pistons connected respectively to a plurality of rotatable crankshafts disposed within the engine body and positioned with respect to the axes of the reciprocating pistons, said crankshafts connected by gears or other connecting means to a rotatable central shaft so that the rotation of said central shaft is related to and dependent upon the reciprocating movements of said pistons; a plurality of rollers affixed to the sides of said central shaft at one end, which connect the central shaft to the displacer by means of a camming groove machined into the displacer in which said rollers ride; an electromagnetic induction rotor affixed to the opposite end of said central shaft which rotates in conjunction with the central shaft; a plurality of centrifugal pumps connected by means of coupled shafts to the aforesaid crankshafts, said pumps housed within the engine body and connected by means of coolant passages within the engine body, to heat exchangers affixed externally to the engine body and disposed adjacent and parallel to the exterior plane of the engine body; an electromagnetic stator comprised of field windings formed of electrical conductors, said stator mounted externally to, and unconnected mechanically to, the engine body; an engine mounting frame which supports the engine body and attaches the entire machine to the device or load to be driven, or to an engine support of some sort, said frame also supporting the stator and peripheral equipment; a connecting means affixed to the body of the engine for the purpose of transmitting the motion of the engine body to an output shaft mounted in the engine frame; a plurality of engine support bearings which support the engine body within said frame; filler and drain plugs located in the exterior surface of the engine body for the purpose of adding or removing coolant or lubricant; a seal mounted on, an disposed annularly about, the upper end of the ceramic coupling which joins the displacer shaft and displacer shaft head, said seal composed of titanium or other high temperature material; a hollow washer and ring seal located beneath the heater head liner, and disposed annularly about the displacer shaft coupling, said seal composed of titanium or other high temperature material; a seal located in the upper displacer shaft bearing support plate, and disposed annularly about the displacer shaft; a seal located in the lower displacer shaft bearing boss, and disposed annularly about the rotor end of the displacer shaft; an oil circulating pump or means attached to, and disposed annularly about, the displacer shaft, said means promoting lubricant to the displacer shaft bearings and other engine parts requiring lubrication; a plurality of bearings within the engine body, which support the displacer shaft and piston crankshafts in their respective positions; a one-way valve located atop the displacer, said valve provided for the purpose of allowing automatic escape of working gas entrapped beneath the displacer; a plurality of roller bearings affixed to the sides of the displacer, which guide the displacer within a heater head liner which fits inside the heater head in close contact with the metal foam lining, said rollers riding in guide slots made into the inside surface, parallel to the axis of said heater head liner; a plurality of quick-connect valves located in the respective cylinder sleeve retaining fittings which seal the cylinder cavities, at the surface of the engine body, said valves allowing the addition or removal of the working gas, a ceramic thermal break which fits between the heater head assembly and the engine body, to reduce conduction between the heater head and engine body; a plurality of passages made through the ceramic thermal break, which conduct the working gas between the heater head and the gas cooler tubes to the cylinders, said gas cooler tubes disposed from the ceramic break to the respective cylinders through the coolant jacket of the engine body; a plurality of porous metal disks, said discs disposed within the aforesaid passages in the ceramic break, said discs acting as regenerative devices which remove and restore thermal energy from and to the working gas as it passes through said discs.

* * * * *